United States Patent [19]

Feinberg

[11] Patent Number: 4,565,415

[45] Date of Patent: Jan. 21, 1986

[54] SOCKET FOR FLUORESCENT LAMPS

[75] Inventor: Albert E. Feinberg, Chicago, Ill.

[73] Assignee: Advance Transformer Co., Chicago, Ill.

[21] Appl. No.: 526,913

[22] Filed: Aug. 26, 1983

[51] Int. Cl.[4] ..... H01R 33/08

[52] U.S. Cl. ..... 339/50 R; 339/52 R; 339/53; 339/222

[58] Field of Search ..... 339/53, 50 R, 51, 52 R

[56] References Cited

U.S. PATENT DOCUMENTS

| | | | |
|---|---|---|---|
| 2,510,628 | 6/1950 | Goebel | 339/53 |
| 2,573,007 | 10/1951 | Goebel | 173/328 |
| 2,575,597 | 10/1951 | Semeyn | 339/53 |
| 2,767,349 | 10/1956 | Feinberg | 339/53 |

FOREIGN PATENT DOCUMENTS

| | | |
|---|---|---|
| 237104 | 11/1963 | Austria . |
| 118722 | 6/1944 | Switzerland . |
| 532590 | 1/1941 | United Kingdom . |

*Primary Examiner*—Gil Weidenfeld

*Assistant Examiner*—David L. Pirlot

*Attorney, Agent, or Firm*—Silverman, Cass & Singer, Ltd.

[57] ABSTRACT

Sockets for fluorescent lamps of the type which have a pair of parallel bayonet pins in each end thereof, the lamp adapted to be moved at right angle to the axis of the lamp in order cause the pins at opposite ends to enter grooves or channels formed in the socket. Rotation of the lamp rotates the four pins to detent positions where electrical conductive engagement is made with electrical contacts provided in the socket by means of which circuits may be completed between the lamp filament ends and other electrical components. The sockets of the invention have channels formed therein which lead the lamps to rotate about 135° before electrical conductive engagement can be made. Additionally the lamps must be rotated in a particular direction in order to effect the seating thereof and when so seated the lamps are substantially captured in dead end grooves providing a high measure of reliability and safety.

13 Claims, 8 Drawing Figures

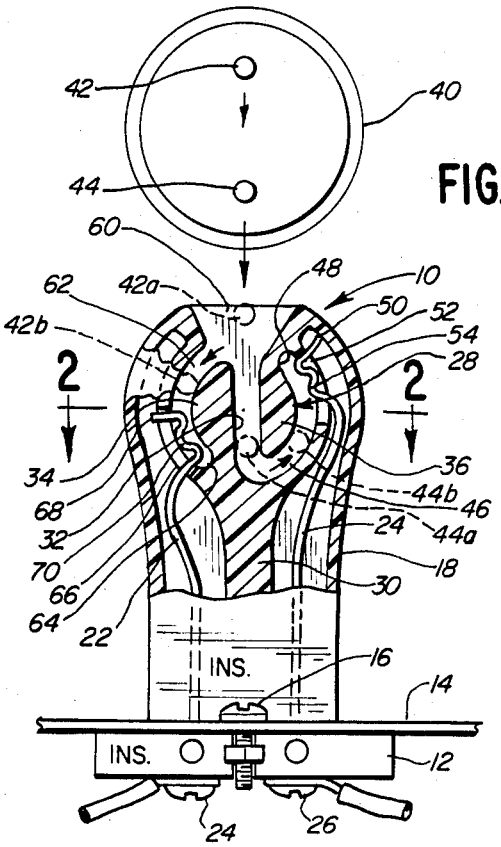
FIG. 1
FIG. 2
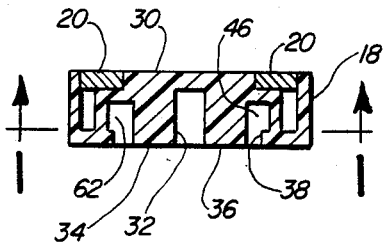
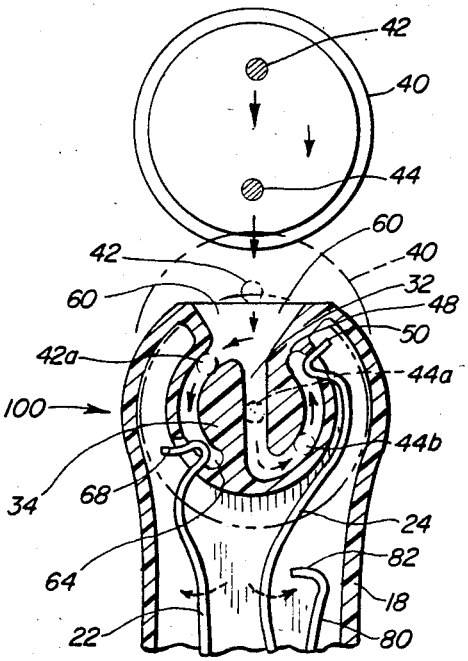
FIG. 3
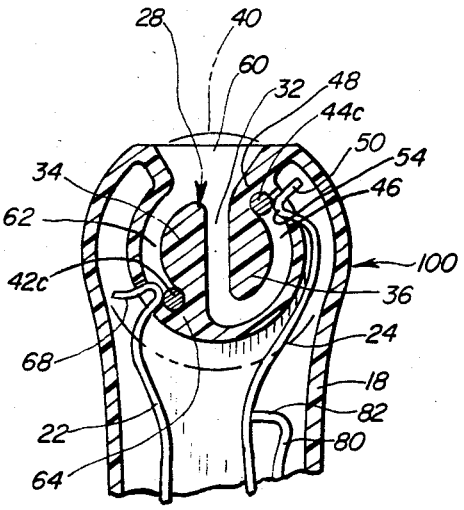
FIG. 4

FIG. 5
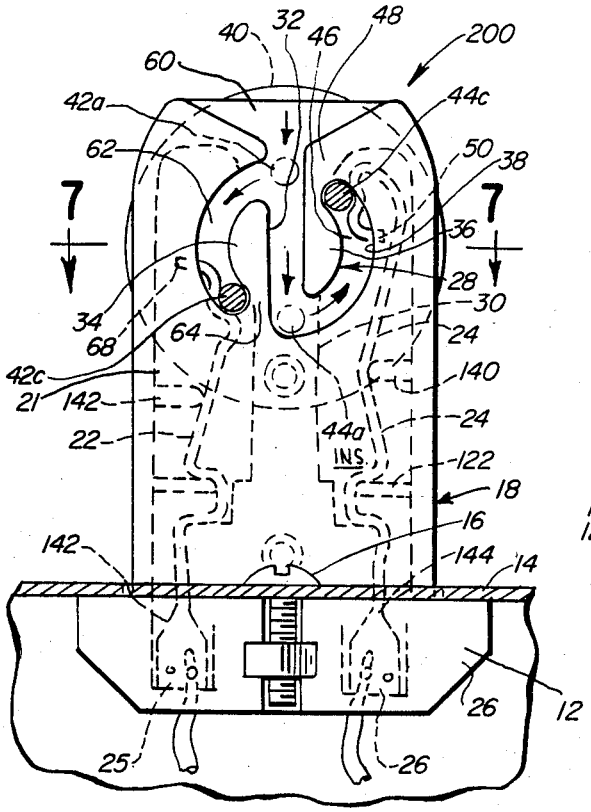
FIG. 6
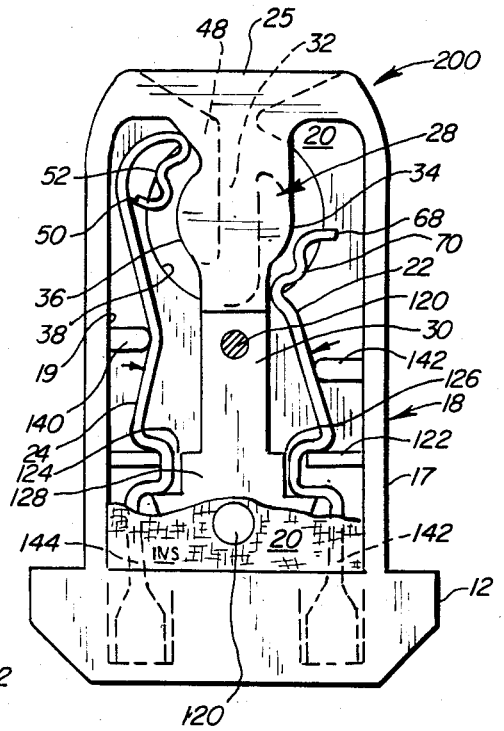
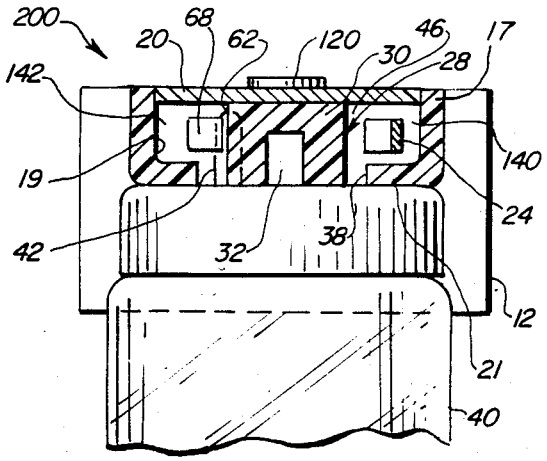
FIG. 7
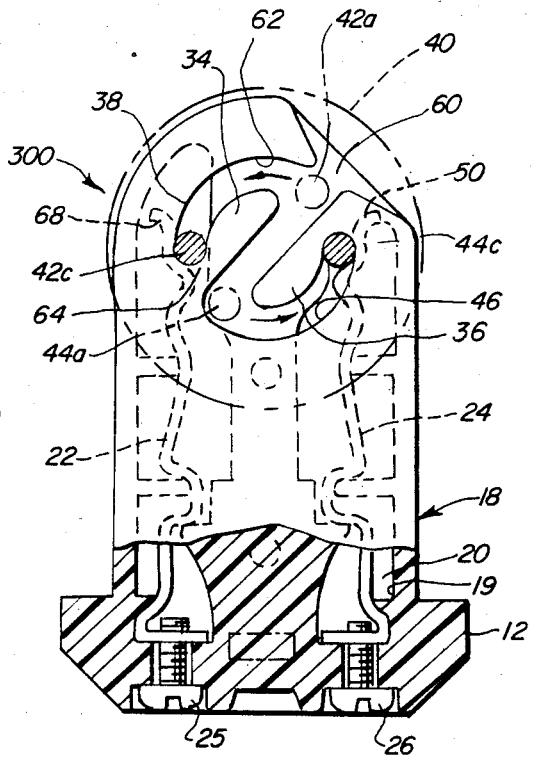
FIG. 8

SOCKET FOR FLUORESCENT LAMPS

FIELD OF THE INVENTION

The field of the invention comprises sockets for mounting fluorescent lamps in electrical fixtures and more particularly is concerned with sockets which are designed for the reception of the kind of fluorescent lamp which has at each end thereof two axially extending bayonet pins, these pins being equally spaced from the axis of the lamp and lying on a diameter thereof. The most common type of lamp with this construction is the rapid start fluorescent lamp which has a filament in each end and requires two end connections at each end of the lamp.

BACKGROUND OF THE INVENTION

The basic structure of the common fluorescent lamp socket for reception of a pair of bayonet pins is well-known because such sockets are in wide-spread use. Two prior art patents which disclose devices of this particular nature are U.S. Pat. Nos. 2,295,575 and 2,767,349. The latter of these two patents also discloses the adaptation of the socket for use with a third electrical contact to provide a so-called disconnect arrangement to achieve certain safety measures.

The invention herein obviates or substantially decreases the need for disconnect sockets but can be applied to disconnect sockets for added safety.

The ordinary socket in its frontal aspect, i.e., facing the lamp, presents a circular recess which has a lateral entrance or guide passageway leading to the interior of the face of the socket alongside of the recess so that both pins enter to the interior from one side of the circular recess through the guide passageway. When the pins are moved transverse of the circular recess there is a central peg coaxial with the recess split up its center and integral with the back wall of the socket housing to define a pin channel extending diametrically across the recess. When fully aligned with the recess the pins may be rotated either way to make contact.

The electrical contacts present facing V-shaped resilient contact arms on opposite sides of the circular recess, the pins adapted to be led into engagement with the respective ends of these arms during insertion of the lamp after which the detent effect leads the pins to the bights as the lamp is rotated, one entering a bight from the top of the recess and the other entering its bight from the bottom of the recess.

One of the problems with the ordinary fluorescent lamp socket is that when a pair of the fluorescent lamp pins is inserted into the front of the socket it requires very little movement, i.e. rotation of the pins to establish engagement with the contacts so that it is possible for the contacts to be established at one end of the lamp in its socket without actually seating the pins at the opposite end of the lamp in that socket.

According to the invention the socket is constructed so that the electric contacts are located at the ends of respective arcuate passageways or channels, the channels beginning at the pin entrance alongside the circular recess and extending in a generally pinwheel relation with one another to the dead ends of the channels. It is only when the pins have been rotated about 135° that contact can be made between pins and contacts so that the chances of electrical engagement between the pins and the contacts of the socket are otherwise very little. This not only holds true for each socket but as well holds true in that the lamp must have both pair of pins seated before electrical engagement is likely to occur.

This means that electrical shock is unlikely even if a service man holds one end of a lamp and attempts to insert the other end in a socket. Where there is a disconnect contact to be engaged, the chances of a shock occurring are even less.

The sockets of the invention are not symmetrical; hence they are required to be formed as matching right and left sockets for each pair and must be properly mounted. It will also be noted that unlike the conventional sockets the lamp must be rotated in only one direction to achieve electrical engagement between pins and contacts. The construction prevents rotation in an improper direction.

SUMMARY OF THE INVENTION

A fluorescent lamp socket for use with the type of lamp that has a pair of axially extending pins at each end thereof, the lamp adapted to be rotated less than a revolution in order to cause the pins to engage respective electrical contacts carried by the socket. The socket face has a pair of grooves or channels. The socket has a pin guiding passageway that is in S-shaped configuration with the opposite arms of the S adapted to hold respective lamp pins in the outermost ends thereof. Access to the passageway is obtained by an opening in the side of the passageway aligned with the crossbar of the S, and a guide recess at the entrance to this opening enables the lamp pins to be moved laterally with the lamp into the crossbar to be disposed substantially at opposite ends of the crossbar. Thereafter the lamp may be rotated on its axis to carry the pins in a rotary direction opposite to one another to enable the pins to be seated. The socket has electrical contact members mounted at ends thereof opposite to the end where S-shaped passageway is located with free ends of the contact members engaging into the respective arm ends so that when the pins are so held contact is established between each pin and the free end of a respective electrical contact member. Rotation of the lamp to seat the pins is possible in only one direction because of the stop means produced as a result of the S-shaped passageway configuration.

BRIEF DESCRIPTION OF THE DRAWINGS

FIG. 1 is a diagrammatic front-on elevational view of a fluorescent lamp socket according to the invention with portions shown in section along the line 1—1 of FIG. 2, whose purpose it is to explain the invention rather than to illustrate a practical embodiment thereof, a lamp being shown in process of rotation for seating the same;

FIG. 2 is a sectional view taken generally along the line 2—2 of FIG. 1.

FIG. 3 is a diagrammatic fragmentary view similar to that of FIG. 1 but illustrating the invention as embodied in a disconnect socket arrangement, the lamp being only partially seated;

FIG. 4 is similar to that of FIG. 3 but showing the lamp fully seated;

FIG. 5 is a frontal elevational view of a more practical embodiment of the invention;

FIG. 6 is a rear elevational view of the fluorescent lamp socket of FIG. 5 with portions broken away;

FIG. 7 is a sectional view taken generally along the line 7—7 of FIG. 5 and in the indicated direction; and FIG. 8 is a view similar to that of FIG. 5 but illustrating another embodiment of the invention.

DESCRIPTION OF THE PREFERRED EMBODIMENTS

The fluorescent lamp socket of the invention departs in its detailed structure very little from conventional sockets so that it should be economical to manufacture using known techniques and types of tooling.

In FIG. 1 there is illustrated a simplified form of fluorescent lamp socket 10 having a base 12 that enables the socket 10 to be mounted to a metal fluorescent fixture 14 by any suitable fastener 16. The socket 10 includes a vertically extending hollow housing 18 closed off at its rear by a cover member 20. Electrical contact members 22 and 24 extend from the upper interior of the housing 18 and connect with terminals 25 and 26 respectively at the bottom end.

There is a cylindrical peg 28 molded integrally with the back spine 30 having a vertical pin passageway or linear channel 32 along its center dividing it into semicylindrical lobes 34 and 36. Combined with the inwardly facing surface of the housing 18, the peg 28 forms an interrupted circular recess 38 opening axially toward the front of the socket 10, i.e. toward that part which will face the lamp. The recess 38 does not form a complete circle. A diagram of a lamp 40 with a pair of pins 42 and 44 is shown in FIGS. 1, 3 and 4. The pins 42 and 44 are intended to be aligned vertically as shown at the top of FIG. 1 and the entire lamp 40 moved downward tranvsersely of its axis so that both pins 42 and 44 will enter the pin passageway 32. The lower pin 44 moves to position 44*a* while the upper pin 42 moves to position 42*a*.

At this point in the conventional socket the recess 38 will stop movement of the lamp downward because the pin 44 engages the recess edge but the lamp is free to be rotated clockwise or counter clockwise around the interrupted circular recess 38 which is a complete circle in the conventional socket. According to the invention the paths which can be followed by rotation of the pins in the socket 10 are limited and confined by structure added to the socket and supported by the spine 30 or any other suitable means.

The bottom end of the pin passageway 32 connects with an arcuate passageway or channel 46 formed in the spine 30 and connected therewith. This passageway or channel 46 follows the contour of the lobe 36 up to the top of the lobe 36 at the dead end 48. This dead end 48 comprises stop means for limiting the rotation of the lamp 40 in its socket 10. Adjacent the stop means 48 the upper free end 50 of the contact member 24 enters a suitable slot or opening 52 and extends into the passageway 46 and presents a resilient detent 54 to the pin 44 as it moves from position 44*a* to position 44*b* in FIG. 1. When fully engaged all the way at the end 48 of passageway 46 the pin 44 will look like that shown at 44*c* in FIG. 4.

Entrance to the socket 10 from the top end thereof is gained by means of a guide recess or passageway 60.

Once the lamp pins 42 and 44 have been engaged in the recess 60 and the passageway 32 the lamp 10 can only be rotated in a counter clockwise direction as viewed in FIG. 1 because the passageway 46 is blocked off at the top thereof. Instead there is another arcuate passageway or channel 62 that opens adjacent the top end of the pin passageway 32. The configuration is the same as that of passageway 46 but extends around the lobe 34 to the bottom of the lobe. Here the passageway or channel 62 is a dead end forming the stop means 64 adjacent to which there is a slot 66 in the passageway through which extends the upper end 68 of the contact member 22. A detent formation 70 provides the holding arrangement to retain the pin 42 in the passageway 62 as shown at 42C in FIG. 4.

In looking at the socket 10 it appears that the recess 38, the passageways or arcuate channels 46 and 62, the pin passageway or linear channel 32 and related structure provide a passageway or groove for guiding and confining the pins 42 and 44 during their movement and when they are seated which has an S-shaped configuration. The S is lying on its side, the right arm comprising the passageway 46 and the left arm comprising the passageway 62. The crossbar of the S is the pin passageway 32. There is a side entrance to the S-shaped passageway which is at the top in FIG. 1 comprising the guide passageway 60. It is aligned with the crossbar so that when the lamp 40 is translated downward while remaining parallel to its initial axis both pins 42 and 44 will be carried to their positions shown in FIG. 1 at 42*a* and 44*a*. From these positions the pins move to the ends of the respective arms of the S where they are seated in electrical engagement with the contact arm ends 50 and 68.

The S is uniform, considering its graphic configuration, so that the halves are perfect reverses of one another. If standing erect and not lying on its side, the crossbar would be perfectly horizontal. In the case of the sockets of FIGS. 1 to 4 the S is lying on its side and the crossbar, which is mentioned previously is the central pin passageway 32, is disposed vertically. The lamp is capable of rotation on its axis of about 135° but could provide the benefits of the invention with less rotation in a different socket construction.

Considering the socket 10 as one of a pair for mounting the lamp 40 these sockets must be image pairs because rotation of the lamp within the sockets is permitted in only one direction due to the presence of the stop means 48 and 64 in each socket. Thus there will be a mate for socket 10 having the S-shaped passageway equivalent to that of the first, but a mirror thereof. The lamp is inserted as shown in FIG. 2, the pins 42 and 44 at both ends moved downward into the pin passageway 32 and then rotated in a counterclockwise direction relating to FIG. 1, while moving in a clockwise direction if one were looking at the inwardly facing wall of the mate of the socket pair. This latter socket is not shown because it is disposed "out of the paper" as it were.

The manufacturer has to make two different sockets for each lamp and these must be marked for proper mounting and pairing. In most cases the contact member 22 and its mirror member (not shown) can be made with contours so as to enable ready reversal for use in right and left sockets. This can likewise be done for member 24 and its mirror member. Otherwise, the added expense required for stamping four differently configured contact members for each pair of sockets should not add prohibitively to the overall cost of the sockets.

The socket 100 of FIGS. 3 and 4 differs from the socket 10 in the small respect that it also provides for a disconnect contact member 80 on the interior of the housing 18. (The same reference characters are used for components of FIGS. 3 and 4 equivalent to those of FIGS. 1 and 2.)

In FIG. 3 the lamp 4 has been moved downward parallel to its axis, bringing the pins 40 and 42 into the guiding recesses 60 of both sockets and the lower pins 44 partway into the pin passageways 32 as indicated at 42*a* and 44*a*. The next position of lamp is achieved by moving the pins 44 further down the passageways 32 and the pins 42 to the entrances of passageways 32 from which position the lamp 40 is rotated in a counterclockwise direction to bring the pins 44 to the position shown at 44*b* within the passageways 46 and the pins 42 to position shown at 42*b* within passageways 62. The lamp 40 is not fully seated and, as can readily be seen, electrical engagement of the pins with the respective contact members 22 and 24 has not been effected. The lamp is well-engaged in the confining passageway of its sockets and shock hazard is almost impossible.

In this condition, i.e. as shown in FIG. 3, the disconnect electrical contact member 80 in the housing 18 has its engaging end 82 free of the contact member 24. Electrical engagement will not be made until the lamp 40 has been fully rotated to its seated condition shown in FIG. 4. Here the pins 42 and 44 are now fully at the dead ends of their respective passageways 46 and 62 at the stop means 48 and 64 as indicated at 42*c* and 44*c*. The pins have ridden over the detent projections at the ends 50 and 68 and are thus resiliently locked in place by the contact members 22 and 24. The contact member 80 has a separate electrical terminal (not shown) in the base of socket 100.

The fluorescent lamp socket 200 of FIGS. 5, 6 and 7 is quite similar to those shown in FIGS. 1 to 4, differing only in certain details. Inclusion in the specification is to illustrate how simple a structure can be according to the invention without departing radically from the construction of commercial devices. The socket 200 approaches in construction very close to that of commercial devices.

To the extent feasible the same reference characters will be used throughout FIGS. 5, 6 and 7 to identify the same or equivalent components and parts in FIGS. 1 to 4.

One may follow the nature of the detailed structure more readily by keeping in mind that the pin passageway is in the form of an S with a side entrance for admitting the pins to the crossbar and with the free ends of the electrical contact members engaging the lamp pins at the ends of the S arms equivalent to the dead ends of the passageways 46 and 62.

The socket 200 includes a vertically extending hollow housing 18 molded from plastic and having an integral base 12 by means of which the socket 200 can be mounted to a wall of a metal lighting fixture 14 which carries the lamps for illumination. The base 12 is shown below the wall 14 which means that said base is on the interior of the fixture housing so that connection may be made in the lamp circuit by way of the terminals illustrated at 24 and 26. This is a type of terminal which may be formed right on the electrical contact members 22 and 24 by suitable punching, bending and so forth to give rise to a structure which enables wire ends to be pushed into a piercing or scraping association obviating the need for screw terminals of a more common type. The terminal construction is of no concern to the invention herein.

Throughout the drawings including FIGS. 5 to 7 the fluorescent lamp socket is shown with the base 12 at the bottom of the view and reference has been made to the upper end of the view being the top, i.e., that the lamp is moved downward in inserting the same into the guide 60. As a practical matter these sockets are installed in different dispositions so that all directions given should be considered relative. In the views shown the mounted base or pedestal 12 is at the bottom of the view but probably would be disposed as the top end of the assembly so that the fluorescent lamp is dependent from the fixture plate 14 within the fixture.

A nut and bolt type fastener arrangement is shown at 16 holding the socket 200 to the top of the fixture plate 14, the majority of the base being below the plate to hide wire connections and guard against accidental interference between wire leads connected to the terminals 24 and 26 as well as other electrical wires and components mounted in the fixture.

The housing 18 has an open back and a closed front, an interior chamber 19 being formed by the front wall 21, the side walls 17, the base 12 and the upper end wall 25. A spine 30 extending along the center of the housing 18 connects everything together and divides the chamber into two vertical halves. The chamber 18 is normally closed off on its rear by an insulating plate 20 held in place by the rivets 120. A cross brace 122 slotted at 124 and 126 is molded integrally with the spine 30 and the continuation 128 that extends to the bottom of the socket. The terminals 24 and 26 are mounted in any suitable type of chamber formed to enable their utilization.

An important difference between socket 200 and the socket 10 is that in the case of the socket 10 an attempt has been made by suitable molded structure to close off and confine the passageways 62 and 46 while in the socket 200 the passageways 62 and 46 are more or less open as in today's commercial devices.

The front wall 21 has a tapered piloting pin guide or recess 60 that leads the pins of the lamp downward to enter the vertical pin passageway 32 formed in the cylindrical peg 28. This passageway is the crossbar of the S-shaped configuration. The peg 28 is molded to be integral with the spine 30 and, because of the passageway 32, forms two lobes 34 and 36 of semicylindrical configuration about which the pins 42 and 44 rotate, the lobes 34 and 36 being solid. A circular pin recess 38 is perforated through the front wall coaxial of the peg 28 to give open access to the chamber 19 following the contours of the lobes 34 and 36 but being closed at opposite circumferential ends to form what are in effect dead end arcuate slots. The pins 42 and 44 will extend into the respective halves of the circular recess 38 and be confined and guided in circular movement even though the halves otherwise open to the chamber 19.

In the structure shown, in FIG. 5 the bottom end of the central pin passageway 32 opens only to the right of the spine 30 while a continuation of the lobe 34 forms an obstruction 64 preventing movement of the pin 44 out of the pin passageway 32 to the left in FIG. 5. The lamp 40 can thus only be rotated in a counterclockwise direction after it has been fully moved downward in the pin passageway 32. At the same time the pin 44 reaches the bottom end of the passageway 32 at 44*a*, in the first part of its movement the pin 42 has reached the position shown at 42*a* in FIG. 5 at the juncture of the passageway 32, passageway 62 and guide 60. The entrance to the passageway 62 to the left as viewed in FIG. 5 enables the pin 42 to enter this passageway and rotated in a counterclockwise direction. The passageway 62 in this structure is an arm of the S-shaped configuration and is defined throughout its length by the circumferential exterior surface of the lobe 34, the left hand edge in FIG. 5 of the interrupted circular recess 38 (which is a relatively thin edge) and the surface of the bottom wall cover member 20. The lamp 40 will limit axial movement of the pins between th.e surfaces 21—21 of a pair of facing sockets so that there is little or no dependence upon this support by the cover member 20. A thin molded extension of the lobe 34 on its rear surface under the passageway 62 may be provided if desired for additional definition of the passageway 62. Likewise the passageway 46 is defined by the circumferential exterior surface of the lobe 36, the right hand half in FIG. 5 of the recess 38 (which is also a relatively thin edge) and the surface of the bottom wall cover member 20. An extension may be provided on the lobe 36.

The passageway 46 is formed exactly like the passageway 62 but is a reverse configuration, that is, its entrance is at the bottom of the right hand (FIG. 5) half of the circular recess 38 and its entrance is at the bottom end of the vertical pin passageway 32. It is the other arm of the S-shaped configuration. A continuation of the lobe 34 forms an obstruction 48 preventing movement of the pin 42 into the passageway 46 while inserting the lamp because the lamp cannot be turned in a clockwise direction (as viewed in FIG. 5).

Thus, in installing the lamp 40 it is inserted into the socket 200 in the conventional way by the downward movement into the pin passageway 32 but thereafter it must be turned in a counterclockwise direction in order to seat the pins. The pins move around their respective passageways 46 and 62 simultaneously and are finally seated at the respective dead ends of their slots. In the meantime the pins must pass the free ends 50 and 68 of the contact members 22 and 24 respectively. Each of these free ends is biased by virtue of the resilience of the members and, if needed, bracing means to bias the free ends 50 and 68 to move toward one another. Inasmuch as the ends are disposed in the respective passageways 62 and 46 as shown they block the pins 42 and 44 from reaching these passageway dead ends. In installing the lamp 40 these free ends 50 and 68 are initially disposed as shown in FIG. 6 blocking the arcuate passageways 46 and 62. After installation the pins have forced themselves past the free ends 50 and 68 and come to rest in the dead ends of the passageways as shown at **42*c* and 44*c*. In this last phase movement the pins are seated in the final substantially locked positions by the cooperation between the pins and the detent configurations of the free ends, these detent configurations being shown at 52 and 87 in FIG. 6**. These dead ends are the ends of the arms of the S-shaped configuration.

In addition to the resilience of the members 22 and 24 because they are made of some suitable electrical metal such as phosphor bronze, the pushing bias is provided by cams 140 and 142 which are molded integrally with the side walls 17. A previously mentioned cross brace 122 is molded in place below the cams with the slots 124 and 126 through which the contact members 24 and 22 pass for stabilization of the bottom ends of the contact members.

Below the cross brace 122 the lower contact member ends 142 and 144 are bent or otherwise formed into suitable metal configurations for enabling the connection or securement thereto of some form of terminal members 25 and 26, respectively. For example, if the contact members 22 and 24 are stamped from sheet metal (although they need not be stampings) and are flat strips they could be formed by a half twist into plates that could have suitable slots, holes, etc. for the reception of wires or wire fasteners. This structure is not important to the invention and can take any form.

It has been pointed out that the passageway for movement of the pins 42 and 44 can be considered to have S-shaped configuration with the pin passageways 46 and 62 and their accompanying structure comprising the arms of the S and with the central pin passageway forming the crossbar of the S. The pins enter the side of the S at the juncture between one of the arms and the crossbar by virtue of the guide recess 60 which is in alignment with the crossbar so that the pins move in a rectilinear path as the lamp 40 is translated parallel to its axis. In the case of the sockets thus far described the S is uniform with the crossbar vertical and parallel with the housing 18. In the case of the socket of FIG. 8 the S is disposed at an angle with the crossbar at an angle relative to the housing 18. In both cases the housing is arranged as shown in the views and without regard of how it will be disposed during installation.

In FIG. 8 there is illustrated the construction of a fluorescent lamp socket 300 which embodies modifications of the invention. One of these is that the lamp 40 must be inserted on a particular angle relative to the vertical so that there is less shock hazard and the other is that the contact members 22 and 24 are identical in construction but are mounted in reverse to one another. This latter is achieved by having the entrance guide recess 60 on an angle thereby bringing the seating dead ends of the passageways 62 and 46 to the same level. The contact members 22 and 24 thus have the same length and may be of identical construction. Economy of manufacture is thus effected.

Otherwise the construction of the socket 300 is similar to the construction of the sockets 10 and 200. The terminals 25 and 26 are somewhat different merely to show an alternate form.

In all cases of use of the sockets of the invention there will have to be pairs, one oriented right and the other left, and these must be installed during assembly of the fixture carrying the sockets in the proper manner. The insertion of the lamps into the sockets must be done in accordance with the orientation of the sockets because each lamp can be installed by turning it only in one direction and removed by turning it only in the opposite direction. This slight inconvenience is more than offset by the safety produced through the use of the sockets.

It is contemplated that the most practical degree of rotation of the lamp to achieve the benefits of the invention from the standpoint of safety and ease of fabrication is about 135° but the invention is not limited to this angle. The only requirement is that the angle be sufficiently less than 180° to enable the socket to have structural strength at places where it is put under mechanical stress during use. Obviously the insulation quality of the materials used must also be taken into consideration.

It will be manifest that the invention is capable of consideration modification and variation without departing from the spirit or scope thereof as defined in the appended claims.

What is claimed and desired to be secured by Letters Patent of the United States is:

1. A socket for fluorescent lamps of the type which has a pair of parallel contact pins extending axially out of each of its ends, each pair of pins being equidistant from the lamp axis on diametrically opposite sides of said axis, said socket comprising a housing adapted to be mounted to an electrical fixture at one end of said housing and having structure for insulately mounting the pins of a lamp end adjacent the second end of said housing, the socket presenting a front surface to be disposed parallel to the lamp end, said pin-mounting structure comprising means forming a continuous S-shaped symmetrical pathway in said housing opening to said front surface and being formed of an intermediate linear channel and a pair of arcuate channels on opposite sides of said intermediate linear channel, a guide entrance formed in said housing opening to said intermediate linear channel below said front surface from the said second end of the said housing at the juncture of one of the arcuate channels with the intermediate linear channel and said intermediate linear channel adapted to receive the pair of pins of the lamp end in a translating movement of the lamp parallel to its axis, each of said arcuate channels having an entrance and a dead end, the ends of the intermediate linear channel communicating respectively only to the entrance ends of said arcuate channels respectively, said intermediate linear channel forming the sole linear path for both pins and said arcuate channels forming individual arcuate paths for each pin respectively, said arcuate channels being of substantially equal length, each arcuate channel extending over an arc with the respective dead end beyond 90° from the respective entrance, electrical contact means disposed solely immediately adjacent each dead end, equidistant and remote from each entrance of the arcuate channels, said socket having a pair of conductive members mounted to its said one end and capable of being coupled to external electrical circuitry, each conductive member extending within the housing and leading to a respective electrical contact, both pins requiring full engagement within said linear intermediate channel for simultaneous pin entry into both arcuate channels for rotation thereof respectively and translation to the dead ends of said arcuate channels, said lamp being rotatable only subsequent to full disposition of both pins within said intermediate linear channel and electrical contact being effected, subsequent to introduction of said pins into said arcuate channels, only when both pins are at or immediately adjacent the dead ends of the respective arcuate channels, remote from the entrance, and engaged with said electrical contact means whereby to prevent electric shock by inadvertent engagement of one of the pins with the electrical contact means while the lamp is held by the operator and prior to engagement of all pins with their respective electrical contacts and means for seating said pins at the dead ends of said arcuate channels.

2. The socket as claimed in claim 1 in which the S-shaped pathway is disposed on its side and the intermediate linear channel lies on a vertical straight line extending directly between the socket ends, said opening to the S-shaped pathway from said guide entrance also lying substantially on said straight line.

3. The socket as claimed in claim 1 in which the S-shaped pathway is disposed at such an angle that its intermediate linear channel forms an angle with a vertical straight line extending directly between the socket ends, the opening to the S-shaped pathway from said guide entrance lying substantially on a line extended from said intermediate linear channel from said entrance.

4. The socket as claimed in claim 1 in which there is a third conductive member mounted to said one end by means of which said third conductive member may be coupled to said external electrical circuitry, there being disconnect contact means within said housing adapted to be operated when one of said electrical contacts is engaged so that the disconnect contact means and the third conductive member become electrically connected within the housing.

5. The socket as claimed in claim 1 in which the contacts are respectively integral with the conductive members.

6. The socket as claimed in claim 3 in which the contacts are respectively integral with the conductive members and the configuration of the combined contacts and conductive members is identical.

7. The socket as claimed in claim 1 in which the S-shaped pathway is described at least partially by the external surface of a cylindrical peg divided by a groove, the groove describing the intermediate linear channel and the resulting half circumferential surfaces of the peg comprising for the most part walls of the respective arcuate channels.

8. The socket as claimed in claim 1 in which said electrical contact means are arranged in said arcuate channels beyond 90 degrees of arc from said intermediate linear channel.

9. The socket as claimed in claim 1 in which said electrical contact means are arranged in said arcuate channels at approximately 135 degrees of arc from said intermediate linear channel to assure a minimum rotation of the lamp of 135 degrees of arc before energization thereof is possible.

10. The socket as claimed in claim 1 including means for locking the pins in position at the dead ends of said arcuate channels.

11. The socket as claimed in claim 10 in which said last mentioned means comprise detents formed in said electrical contacts at the ends of said conductive members.

12. The socket as claimed in claim 1 in which the housing has an interior and the arcuate channels are closed off from the interior of the housing around a substantial portion of their extent.

13. The socket as claimed in claim 12 in which there is an opening in the side of each arcuate channel at the dead end thereof and the electrical contacts are biased to move from outside and into the arcuate channels.

* * * * *